United States Patent [19]

Clark et al.

[11] 4,072,353

[45] Feb. 7, 1978

[54] THRUST-IMPACT ROCK-SPLITTER

[75] Inventors: George B. Clark, Wheat Ridge, Colo.; Terry F. Lehnhoff, Vichy, Mo.

[73] Assignee: The Curators of the University of Missouri, Columbia, Mo.

[21] Appl. No.: 718,115

[22] Filed: Aug. 27, 1976

[51] Int. Cl.[2] ..... E21C 37/02

[52] U.S. Cl. ..... 299/22; 299/15

[58] Field of Search ..... 299/15, 20–22

[56] References Cited

U.S. PATENT DOCUMENTS 1,884,946 10/1932 Wineman ..... 299/22 X 3,488,093 1/1970 Darda ..... 299/22

*Primary Examiner*—Ernest R. Purser

*Attorney, Agent, or Firm*—Ray E. Snyder

[57] ABSTRACT

A rock splitting tool having elongate laterally expanding metal pressure bars or feathers and an axial sliding wedge or spreader for radially separating the feathers, the wedge being driven by the combined and superimposed forces of a hydraulic thrust servomotor and an impact hammer. The driving paths for transmitting forces to the wedge are coaxial and partially in series and partially in parallel.

3 Claims, 2 Drawing Figures

THRUST-IMPACT ROCK-SPLITTER

BACKGROUND OF THE INVENTION

The invention described herein was made in part in the course of work under a grant or award from the National Science Foundation.

1. Field of the Invention

This invention relates generally to the field of Mining or in Situ Disintegration of Hard Material, and more particularly to Expansible Breaking Down Devices having fluid pressed pistons and wedges.

2. Description of the Prior Art

Pressure breakers or rock-splitters are well known in the art and are exemplified by the patents to Darda:

U.S. Pat. No. 3,414,328 Hydraulically Actuated Tool for the Mechanical Breaking of Rocks by Means of a Wedge Slidable through Insert Pieces U.S. Pat. No. 3,488,093 Pressure Breaker U.S. Pat. No. 3,791,698 Hydraulically Operated Apparatus for Mechanical Splitting of Rock and the Like Each of the above patents shows a rock-splitter of the general type involved in the present invention. The splitters each have two or more elongate, wedge-like pressure bars or feathers adapted to be inserted into a pre-drilled hole in a rock or other hard substance, and an elongate central sliding wedge or spreader adapted to be driven axially between the feathers. The driving force for the spreader is most commonly provided by a hydraulic piston which is actuated by high fluid pressure. The total force acting axially on the spreader is the product of the fluid pressure times the area of the piston, and this force is transformed into a radial force and is multiplied manyfold by the mechanical advantage of the feather-spreader configuration. The feathers at first move radially to the diameter of the pre-dilled hole and the radial force generated by the pressure bars then builds up until it is of sufficient magnitude to cause the rock to fracture.

Impact hammers or drills are also well known in the art. Such drills most commonly comprise in elongate cylinder and a heavy metal piston disposed to move longitudinally within the cylinder. Air or other fluid under pressure is supplied from a suitable compressor source and is admitted by suitable valves into the cylinder to cause the piston to oscillate therein. The momentum of the piston is imparted as an impact force against an anvil disposed in the working end of the cylinder. The anvil in turn drives a drill or wedge against a rock or paving to fracture the same. The impact force imparted to the rock may have a peak value in excess of 50,000 lbs.

A U.S. Pat. to Amtsberg, No. No. 3,796,271 teaches a triple coaxial hammer comprised of three hammer elements in telescopic relation for driving a rock drill. Amtsberg's hammer is hydraulically movable on a work stroke, and is returnable by hydraulic force supplemented by force of pressure air. This arrangement provides a relatively wide impact pulse against the drill. It is not used in conjunction with a rock splitter and does not combine the hydraulic and pneumatic forces for driving the drill.

SUMMARY OF THE INVENTION

It is an object of the present invention to provide an improved rock splitting tool that effectively combines the steady force from a hydraulic servomotor with the superimposed oscillating force of an impact hammer for driving an axially slidable wedge between two or more pressure bars.

The combined tool of the present invention has been found to operate for its intended purpose at speeds up to five times as fast as pressure breakers employing a hydraulic servomotor alone.

The composite tool of the present invention may be designed for use as a unitary hand-held tool, carried by a back-hoe or similar mounting, or incorporated into larger machines such as tunnelling machines. In the latter application, it is comtemplated that this tool may totally eliminate blasting as a means of tunnelling or mining through hard rock.

DETAILED DESCRIPTION OF THE PREFERRED EMBODIMENTS

Figure 1:
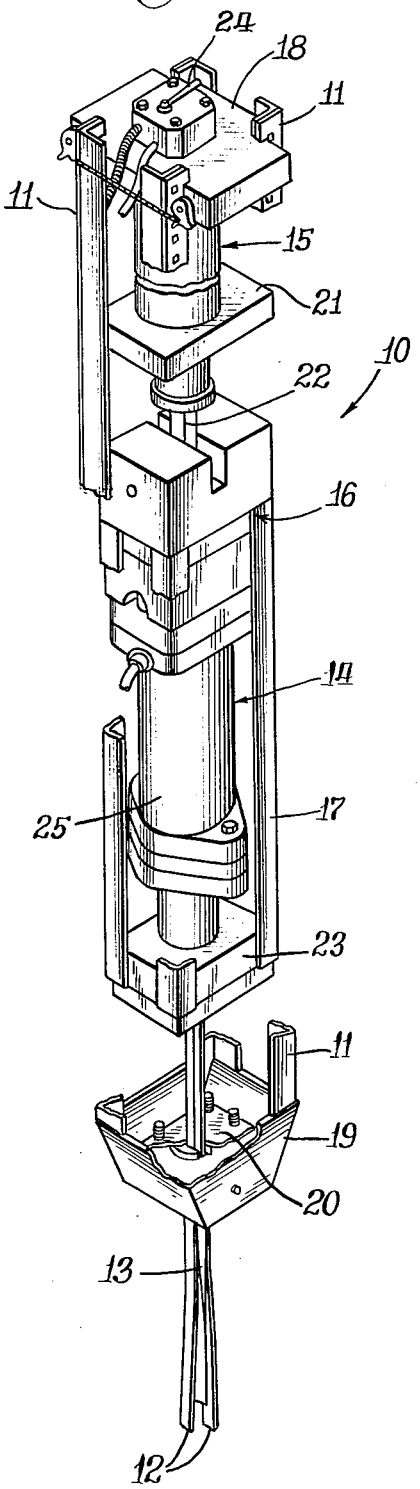
FIG. 1 is a perspective view of a rock-splitting tool driven by a combined hydraulic thrust servomotor and an impact hammer.

The thrust-impact rock-splitting tool of the present invention is designated generally in FIG. 1 by the numeral 10 and is seen to comprise: a main mounting frame 11, a pair of pressure bars or feathers 12, an axially sliding wedge or spreader 13, an impact hammer 14, and a hydraulic thrust servomotor 15, a load division block 16, and a thrust frame 17.

The frame 11 includes an upper end reaction block 18 and a tapered pivoting feather block 19 at its lower end. The feathers 12 are attached to the feather block 19 and are held in place by a spring loaded feather retaining plate 20.

The hydraulic servomotor 15 is attached to and abuts against the reaction block 18 and is also held in place by a mounting plate 21 attached to the frame 11. The thrust of the servomotor 15 is transmitted downward as shown through a connecting rod 22 which acts against the load division block 16. The block 16 is attached to and serves as an upper end of the thrust frame 17. A lower end or block 23 of the thrust frame 17 is connected to the upper end of the wedge or spreader 13. Nearly all of the total force generated by the servomotor 15 is transmitted to the wedge 13 through a path comprising the connecting rod 22, load block 16, frame 17, and lower block 23 to the wedge 13. In a typical embodiment, the servomotor 15 has a piston (not shown) that is several square inches in area, and the fluid operating pressure is several thousand psi so that the total force developed may approach or exceed 100,000 lbs. A arcuately movable valve 24 is mounted on the upper end of the servomotor 15 and is effective to apply or release fluid pressure for operating the servomotor 15.

The impact hammer 14 may be of the compressed air driven type and is mounted longitudinally within the thrust frame 17. The hammer 14 has an external housing 25 and its upper end reacts against the load division block 16. Springs or other resilient means (not shown) are disposed between the upper end of the housing 25 and the load block to preload the hammer 14 by approximately 200 lbs. The lower end of the housing 25 abuts against the block 23. The hammer 14 contains an internal oscillating piston and anvil (not shown) adapted to impart an intermittent impact force against the wedge 13. This intermittent force is additive to and combined with the steady thrust force imparted to the wedge 13 through the thrust frame 17.

In operation, the rock-splitting tool 10 functions as follows:

The rock to be split is pre-drilled to a diameter and depth convenient to receive the feathers 12 and wedge 13 when extended. The frame 11 is oriented coaxially with the pre-drilled hole and the feathers 12 and a portion of the wedge 13 are inserted into the hole. The valve 24 is actuated to direct fluid under pressure to the servomotor 15 advancing the thrust rod 22. The movement of the rod 22 advances the frame 17 and the wedge 13 expanding the feathers 12 radially to the diameter of the hole. Thereafter, the servomotor continues to apply a steady force on the wedge 13 tending to expand the diameter of the hole. The impact hammer 14 is then actuated adding and superimposing an intermittent impact force on the wedge 13. The combined forces have peak magnitudes sufficient to fracture any rock structure wherein adequate relief or room for lateral displacement is available.

In practice, the combined rock-splitting tool 10 just described has been found effective to operate at speeds up to five times as fast as either component acting alone. It is believed that this result can be attributed to the effects of the frictional forces involved, as follows:

The feathers 12, once expanded to the diameter of the pre-drilled hole, bear against the interior rock walls and are held relatively stationary by the forces of friction. These frictional forces are large and are substantially equal to the thrust force developed by the servomotor 15 and a portion of the force developed by the impact hammer 14. Most of the reaction force from the hammer 14 is absorbed by the inertia of the apparatus 10. That the forces of friction at the feathers are large is apparent from the fact that the mounting carriage for the tool 10 is incapable of absorbing the reaction force of many thousands of pounds generated by the servomotor 15. These frictional forces also create huge normal forces and hence huge static frictional forces between the interior surfaces of the feathers 12 and the wedge 13. It is a well known principle of physics that rolling or sliding friction is less than static friction. It is therefore surmised that the almost instantaneous impact forces generated by the hammer 14 are sufficient to overcome the static friction between the wedge 13 and feathers 12 and convert this to sliding friction, allowing the wedge 13 to advance at a significantly increased rate.

Figure 2:
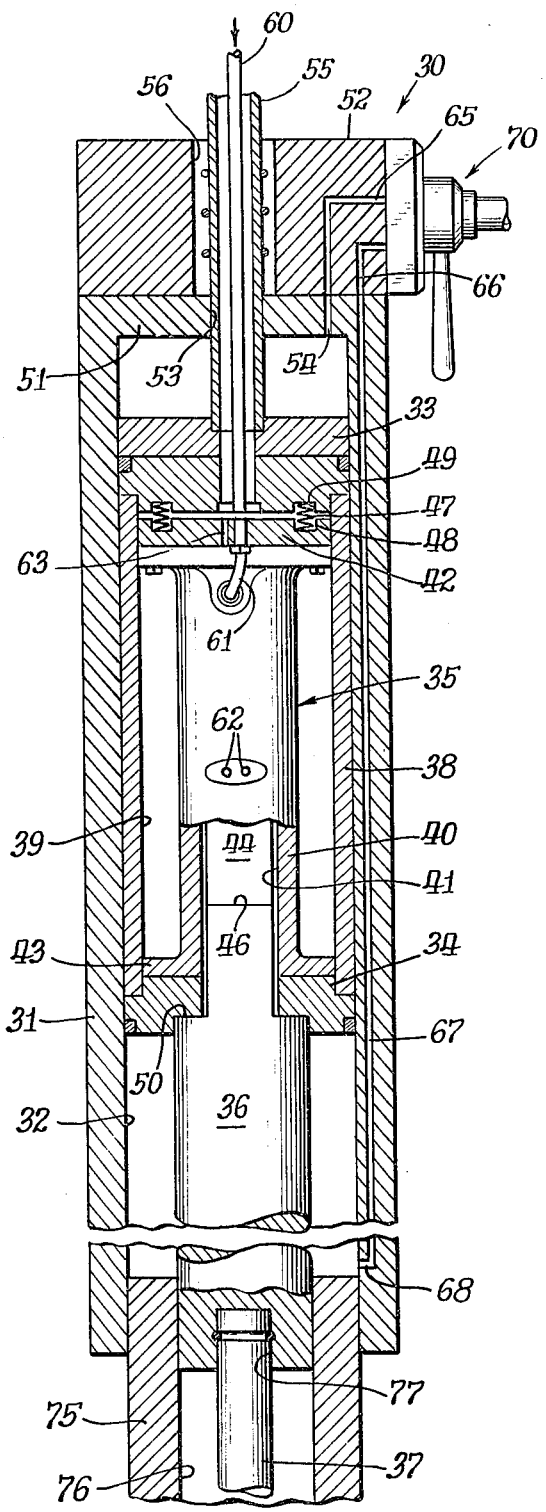
FIG. 2 is a longitudinal cross-sectional view of an integral tool combining the hydraulic thrust motor and an impact hammer in a unitary housing.

Referring now to FIG. 2, there is illustrated a view of an improved rock-splitting tool 30 which incorporates a hydraulic servomotor and impact hammer into an integral unit. The tool 30 comprises a generally cylindrical external housing 31 formed with an internal cylindrical bore 32, a hydraulic pressure apply piston 33 and a hydraulic return piston 34 disposed within the bore 32, an impact hammer 35 disposed longitudinally and sandwiched between pistons 33 and 34, a cylindrical anvil 36, and a power output shaft 37, which may be a wedge or adapted to be coupled directly to a wedge.

The pistons 33 and 34 are disposed to slide longitudinally within the bore 32 and are interconnected by means of a rigid cylindrical sleeve 38. The inner wall of the sleeve 38 defines a cylindrical chamber 39 which contains the impact hammer 35.

The impact hammer 35 has a generally cylindrical external housing 40 formed with an internal cylindrical bore 41, an upper end wall 42, a lower end wall 43, and a heavy metal piston 44 disposed to oscillate longitudinally within the bore 41. The piston 44 is adapted to impact against an upper end 46 of the anvil 36. Springs 47 are disposed under compression within recesses 48 and 49 formed in the upper end wall 42 and lower side of piston 33, respectively. The springs 47 pre-load or bias the housing 40 against the piston 34. The amount of preload may be approximately 200 lbs. The piston 34 in turn bears against a cylindrical shoulder 50 formed on the anvil 36.

The upper end of the housing 31 is formed with an end wall 51 and a control block 52 is mounted on top of the wall 51. The end wall 51 is formed with an axial central bore 53 and a high pressure fluid inlet port 54. A connecting shaft in the form of a cylindrical sleeve 55 is attached to the piston 33 and disposed to slide axially through the bore 53 and through a bore 56 formed in the control block 52. A compressed air conduit 60 extends through the sleeve 55 and is connected to an inlet port 61 formed in the housing 40 of the air hammer 35. The housing 40 is also formed with air exhaust ports 62 which vent into the chamber 39. The chamber 39, in turn, is vented through an exhaust port 63 formed through the upper end wall 42 and opening into the interior of sleeve 55 for venting to atmosphere.

The control block 52 is formed with a high pressure fluid conduit 65 connected to the inlet port 54. The block 52 is also formed with a low pressure fluid conduit 66. The conduit 66 joins with a conduit 67 formed in the housing 31 and opening into the cylinder 32 through a port 68. The port 68 is located at a point near the bottom of the cylinder 32 and beneath the piston 34. A control valve 70 mounted on the block 52 is operable to direct high pressure fluid through the port 54 to actuate the piston 33 and at the same time vent any accumulated fluid beneath the piston 34 through the port 68. The control valve 70 is also operable to direct low pressure fluid through the port 68 to return upward the piston 34 and at the same time vent any accumulated fluid from above the piston 33 through the port 54.

The lower end of the housing 31 is fitted with an internal cylindrical sleeve 75 rigidly mounted within the lower end of the cylindrical bore 32. The interior wall of the cylindrical sleeve 75 defines a cylinder 76 for the longitudinal movement of the anvil 36. The upper end of the power output shaft 37 is attached within a recess 77 formed in the under side of the anvil 36.

In operation, the hydraulic-pneumatic rock-splitting tool 30 functions as follows:

The tool 30 is oriented to drive a wedge 37 between two or move feathers disposed within a pre-drilled hole in a rock. The valve 70 is turned to a pressure apply position and is effective to direct high pressure fluid from a source (not shown) through a conduit 65 and port 54 into the upper end of the cylinder 32. The fluid pressure acts against the top of piston 33 forcing it downward as shown. The total force developed by the piston 33 is transmitted through the sleeve 38 and piston 34 to the anvil 36. The anvil 36, in turn, transmits this steady force to the wedge 37 as the anvil 36 slides downward through the cylinder 76. Once the feathers have expanded to the diameter of the pre-drilled hole, the force continues to build up as previously described. Any residual fluid that may have been present in the lower end of the cylinder 32 is vented through the port 68 as the piston 34 descends.

The impact hammer 35 is then actuated by introducing high pressure air from a source (not shown) through the conduit 60 to the inlet port 61. The air is properly valved within the housing 40 so as to cause the piston 44 to move up and down within the cylinder 41. The momentum of the piston 44 on its downward stroke is imparted at impact to the upper end 46 of the anvil 36. This impact force is superimposed upon the steady force applied by the piston 33 and is transmitted directly through the anvil 36 to the wedge 37. The combined forces are of sufficient magnitude to fracture any type of rock structure wherein adequate lateral relief is available.

Once the rock has been split, the air pressure is cut off to the impact hammer 35 and the control valve 70 is turned to its low pressure apply position. In this position, the valve 70 is effective to direct low pressure fluid through the conduits 66 and 67 and port 68 into the lower end of the cylinder 32. This fluid pressure acts against the lower side of the piston 34 forcing it upward and raising the air hammer 35 and upper piston 33. Any accumulated fluid in the upper cylinder 32 is vented through the port 54 and conduit 65. The tool 30 is then restored to its original position and is ready to repeat the cycle.

It should be noted that the combined tool of the present invention is able to accomplish its intended function with a relatively small total size and weight, and with relatively moderate working pressures. Either tool alone, presumably, could perform the function, if such individual tools were of sufficient size and the materials of sufficient strength. Such tools would become very heavy and cumbersome to work with, which would reduce their maneuverability and overall efficiency.

Other types of impact hammers, such as hydraulically or electrically actuated tools might be used in place of the air hammer shown and described. In addition, it is to be understood that many changes and modifications might be made without departing from the spirit of the invention.

The invention is not to be considered as limited to the embodiments shown and described, except in-so-far as the claims may be so limited.

We claim:

1. A rock-splitting tool having two or more elongate pressure bars and an axially driven central wedge for radially separating the pressure bars, and comprising:

a hydraulically actuated thrust servomotor having a power output shaft for providing a steady output force;

means defining a first force transmission path including an anvil connecting said power output shaft with the wedge;

an impact hammer having a housing and an internal oscillating piston adapted to impart impact forces to said anvil by the momentum of said piston thereby defining a second force transmission path through said anvil to the wedge; and resilient means disposed between said impact hammer housing and said thrust servomotor for pre-loading said impact hammer housing through said anvil against the wedge.

2. The rock-splitting tool of claim 1 wherein said first and second force transmission paths are in parallel and coaxial with the wedge.

3. The rock-splitting tool of claim 2 wherein: said first and second force transmission paths are partially in series by an amount equal to the pre-load provided by said resilient means.

* * * * *